US008440065B1

(12) United States Patent
Hradil et al.

(10) Patent No.: US 8,440,065 B1
(45) Date of Patent: May 14, 2013

(54) ELECTROLYTE COMPOSITION, METHOD, AND IMPROVED APPARATUS FOR HIGH SPEED TIN-SILVER ELECTROPLATING

(75) Inventors: Hana Marcella Hradil, St. Petersburg, FL (US); Edward Frank Hradil, St. Petersburg, FL (US); George Hradil, Barrington, RI (US)

(73) Assignee: TECHNIC, Inc., Cranston, RI (US)

( * ) Notice: Subject to any disclaimer, the term of this patent is extended or adjusted under 35 U.S.C. 154(b) by 319 days.

(21) Appl. No.: 12/794,021

(22) Filed: Jun. 4, 2010

Related U.S. Application Data

(60) Provisional application No. 61/184,816, filed on Jun. 7, 2009.

(51) Int. Cl.
*C25D 3/56* (2006.01)
*C25D 3/60* (2006.01)

(52) U.S. Cl.
USPC ..... 205/253; 205/238; 205/252

(58) Field of Classification Search ..... 205/252, 205/253, 238
See application file for complete search history.

(56) References Cited

U.S. PATENT DOCUMENTS

| | | | | |
|---|---|---|---|---|
| 3,361,652 | A | 1/1968 | Korplun et al. | |
| 3,483,100 | A * | 12/1969 | Baeyens et al. | 205/304 |
| 4,440,608 | A * | 4/1984 | Opaskar et al. | 205/253 |
| 4,844,780 | A | 7/1989 | Lee | |
| 6,176,996 | B1 | 1/2001 | Moon | |
| 6,508,927 | B2 * | 1/2003 | Yanada et al. | 205/241 |
| 6,607,653 | B1 | 8/2003 | Tsuji et al. | |
| 6,998,036 | B2 | 2/2006 | Dietterle et al. | |
| 2004/0232000 | A1 | 11/2004 | Crosby | |

FOREIGN PATENT DOCUMENTS

| | | | |
|---|---|---|---|
| EP | 1477587 | A2 * | 11/2004 |
| JP | 2006144073 | A * | 6/2006 |

* cited by examiner

*Primary Examiner* — Edna Wong
(74) *Attorney, Agent, or Firm* — Chace Ruttenberg & Freedman; LuAnn Cserr

(57) ABSTRACT

The invention provides an electroplating composition, method, and improved apparatus, which enables electroplating tin-silver alloys at high speed and without burning. The composition is an aqueous acidic solution including salts of stannous tin and a monovalent silver, and a complexing agent selected from the group consisting of thiocarbazides and thiohydrazides, and optionally an aldehyde and/or dialdehyde organic brightener compound. A sulfonic acid and a surfactant may also be included. The improved apparatus provides a protective structure substantially surrounding the anode(s) to decrease turbulence and the problematic silver displacement reaction.

19 Claims, 1 Drawing Sheet

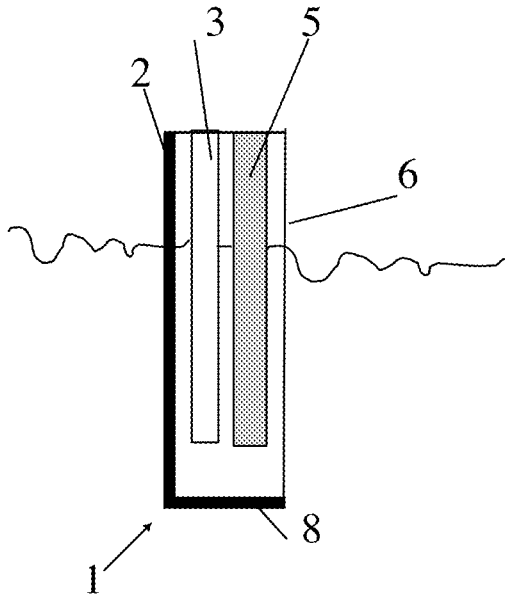
3
5
2
6
8
1

ELECTROLYTE COMPOSITION, METHOD, AND IMPROVED APPARATUS FOR HIGH SPEED TIN-SILVER ELECTROPLATING

CROSS REFERENCE TO RELATED APPLICATIONS

We claim the benefit of U.S. Patent Application No. 61/184,816 filed Jun. 7, 2009, the entire content of which is hereby incorporated by reference.

FIELD OF THE INVENTION

The invention is in the field of electroplating. More specifically, the invention relates to an electroplating composition, method, and improved apparatus for the electro-deposition of tin-silver alloys capable of operation at high speed.

BACKGROUND

Tin-silver coatings are now employed in the electronics and connector industries, replacing the use of pure tin or more expensive pure silver, or gold coatings. Moreover, tin-silver alloys are superior to pure tin (as a replacement for gold) due to the alloy's lower coefficient of friction, which reduces connector insertion forces and prevents connectors from "freezing" together, facilitating multiple insertion cycles. The substrate metal onto which the coating is deposited is typically copper or copper alloy, although other metals may also be used. A tin-silver alloy near the eutectic composition of 96% to 97% tin is usually desired in these applications. In the connector industry, reel to reel plating machines having current densities between 75 and 400 ASF are employed in high speed electroplating processes. The electrolyte must deposit an alloy that does not vary greatly in composition with changes in current density and in bath operation parameters, such as temperature and metal concentrations.

Electro-deposition of alloys is generally more difficult than electro-deposition of pure metals. Differences in the standard reduction potentials of the metals to be deposited cause the difficulties. If the standard reduction potentials are similar, for example tin and lead, electro-deposition presents no problem; the alloys are deposited from simple acid electrolytes and the composition of the deposited alloy is controlled by the relative concentration of the metals in the electroplating solution. If the standard reduction potentials of the metals to be deposited are significantly different, simple acid electrolytes will fail to achieve deposition regardless of the relative concentrations of the metals in the electrolyte. Tin-silver alloys fall into this latter class. Silver has a standard reduction potential of 0.8 V and tin has a standard reduction potential of −0.12 V, indicating that it is much easier to reduce silver to its metallic state than it is to reduce tin to its metallic state. To electro-plate such alloys, it is necessary to complex one or both metals with a complexing agent that brings the standard reduction potentials of the two metals closer to each other.

Another problem arises in tin-silver electroplating: silver immersion plates onto metallic tin surfaces through a displacement reaction between the dissolved silver ions and metallic tin. As a result, silver is reduced at the surface of tin anodes immersed in the electrolyte. Reduction is independent of current flow and results in the continual loss of silver ions from the bath. Silver also immersion plates onto tin-silver cathodes in the absence of current. Complexing silver ions reduces the rate of the displacement reaction but does not eliminate it completely. Silver concentration, bath temperature, and liquid shear rate at the tin surface all influence the rate of the silver displacement reaction. To minimize the displacement reaction, the bath must operate at low temperatures, low silver concentrations, and low liquid agitation around the anodes. These requirements have heretofore prevented high speed electroplating of tin-silver alloys, because high speed electroplating, as used in the electronics and connector industries, is conducted at high metal concentrations, elevated temperatures, and high liquid agitation rates.

Cyanide has been employed as a complexing agent for alloy plating processes; however, the toxicity of cyanide makes it undesirable due to worker safety and waste treatment considerations. Other complexing agents that have been employed with varying low to medium degrees of success include hydantoin (for silver) and gluconate (for tin), see WIPO Patent Publication No. 99/41433 (Toben et al.), alkylsulfonic acids, see U.S. Pat. No. 6,998,036 (Dietterle et al.), pyrophosphate and iodine, see U.S. Pat. No. 5,948,235 (Aria et al.), diamino compounds, see U.S. Pat. No. 5,514,261 (Herklotz et al.), thiourea derivatives combined with alkanol amines, polyethylene imines, and alkoxylated aromatic alcohols, see U.S. Pat. No. 7,151,049 (Beica et al.), and thiourea combined with alkylsulfonic acid and a thio aromatic compound as a brightener, see U.S. Pat. No. 6,099,713 (Yananda et al.).

The current invention specifically addresses these tin-silver alloy electroplating problems by providing an electrolyte capable of high current density operation, at low silver concentrations, that operates near ambient room temperature. The invention also provides a low liquid agitation environment around the soluble anodes to further reduce the displacement of silver onto the anodes.

SUMMARY OF THE INVENTION

The invention provides an electrolyte composition, method, and apparatus that solves the foregoing problems in the art. It can be employed in high speed electroplating processes in the electronics industry and in the connector industry, which has previously not been possible. The composition of the invention is able to run at high speed current densities of 200-300 ASF. It deposits a eutectic or near eutectic alloy that does not vary greatly in composition with changes in current density and in bath operation parameters, such as temperature and metal concentrations.

In one aspect, the electrolyte composition of the invention is an aqueous acidic solution that includes salts of stannous tin and mono-valent silver, and a complexing agent selected from thiosemicarbazides and thiohydrazides.

Stannous tin may be added to the aqueous solution in the form of tin oxide, tin sulfate, tin chloride and other commonly available soluble stannous tin salts know to those skilled in the art. The preferred source of the stannous tin ions is tin alkyl sulfonate, most preferably methyl, ethyl, hydroxy-ethyl (isethionic acid) and propyl sulfonate. The most preferred tin source is tin methane sulfonate. The stannous tin ($Sn^{2+}$) is present in the electrolyte composition at a concentration between 8 to 100 grams per liter and most preferably between 15 to 30 g/l.

Silver is present in the aqueous solution in any known form but preferable in the form of silver methane sulfonate, and in concentrations between 0.5 and 10 g/l, most preferably between 0.8 and 2 g/l. Increasing the concentration of silver in the electrolyte results in higher silver content in the deposited alloy.

The thiosemicarbazide or thiohydrazide complexing agent stabilizes the silver ions in the electrolyte. The reduction potential of the complexed silver ions is closer to that of the stannous tin ions and this allows the co-deposition of tin and silver from the electrolyte. The complexing agent is present in the aqueous solution at a concentration between 2 and 50 g/l, most preferably between 4 and 20 g/l. Various complexing agents have been employed in the art but the inventors have found that thiosemicarbazides and thiohydrazides of the following general formula demonstrate improved results:

$R_1HN$

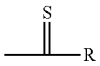

R is $NH_2$ or $NHNH_2$ $R_1$ is H, —$NH_2$ or —$NHNH_2$ or alkyl or alkylcarboxyl or amine or amidino group or $R_2$ $R_2$ is

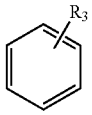

$R_3$ is alkyl or halogen

Exemplary thiosemicarbazide complexing agents include thiosemicarbazide, thiocarbohydrazide, 1-acetyl-3-thiosemicarbazide, 4-methyl-3-thiosemicarbazide, 4,4-dimethyl-3-thiosemicarbazide monohydrate, 4-(2,4-dimethylphenyl)-3-thiosemicarbazide, 3-[(4-morpholino) ethyl]-3 thiosemicarbazide, 4-[3-(4-morpholino) propyl]-3-thiosemicarbazide, 4-(2,6-dichlorophenyl)-3-thiosemicarbazide, and 4-(methyl phenyl)-3-thiosemicarbazide.

A sulfonic acid may be present in the electrolyte at a volume percentage of 5% to 30%, and most preferably between 7% and 25%. The most preferred acids are alkyl sulfonic acid, in particular, methane sulfonic acid (MSA). Other acids known to those skilled in the art may also be used.

The electrolyte composition of the invention may contain at least one surfactant, which aids in providing a smooth surface to the deposited metal. One or more nonionic, anionic or cationic surfactants may be used singly or in combination. The surfactant is present in the aqueous solutions at a concentration of at least 0.1 g/l, preferably at least 0.5 g/l, and most preferably above 1 gm/l. Higher concentrations, above 2 g/l, are not generally beneficial but are not deleterious. Surfactants suitable for this purpose are well known in the art. Exemplary are polypropylene glycols, polyethylene glycols, polyoxyethylene polyol ethers, ethylene oxide-propylene oxide block copolymers, and ethoxylated or propoxylated alkyls, primary, secondary and tertiary linear or branch alcohols. Ethoxylated or propoxylated surfactants represented by the following general formula are preferred:

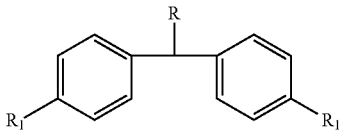

-continued

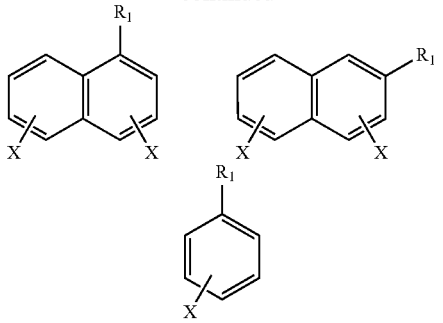

where R is alkyl or iso-alkyl,
$R_1$ is O—$(R_2$—O$)_n$—H,
$R_2$ is ethyl or propyl,
X is a halogen, and
n is between 5 and 20.

The electrolyte composition of the invention may also contain an organic brightener. Numerous brighteners are known in the art and may be used, however either an aldehyde or di-aldehyde is preferred. The organic brightener is present at concentrations between 0.01 g/l and 1.0 g/l, preferably between 0.02 g/l and 0.5 g/l. The aldehyde organic brightener has the following general formula:

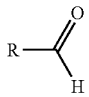

R is H or alkyl or thioalkyl or alkylaryl or alkoxyaryl or cycloalkyl or aryl or heteroaryl Exemplary, preferred aldehydes that may be employed are acetaldehyde, phenylacetaldehyde, 2-methylbutyraldehyde, butyraldehyde, isobutyraldehyde, isovaler-aldehyde, 5-phenyl propionaldehyde, veratraldehyde, iso-nicotinaldehyde, protocatechyl-aldehyde, methylcinnamaldehyde, 4-diethylaminobenzaldehyde, trans-cinnamaldehyde, 4-dimethylaminobenzaldehyde, quinolinecarboxaldehyde, 5-(hydroxymethyl) furfural, 3-ethoxybenzaldehyde, 5-methylfurfural, 3-hydroxynaphthaldehyde, 4-acetamidobenzaldehyde, and 2-hydroxybenzaldehyde.

Alternatively di-aldehydes may be used as the organic brightener. The di-aldehyde organic brightener has the following general formula:

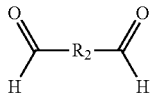

$R_2$ is alkyl or alkylaryl or aryl or heteroaryl

Exemplary, preferred di-aldehydes are pentanedial, phthaldialdehyde, and isophthalaldehyde.

In another aspect, the invention includes a method for high speed electroplating of a 95-98% tin and 2-5% silver tin-silver alloy onto a substrate comprising contacting the substrate with an electrolyte composition as described above and applying to the solution, at a suitable temperature, an electric current in a suitable range until the alloy has plated onto the substrate. Currents in the range of 50 to 400 ASF and temperatures in the range of 21° C. (70° F.) to 32° C. (90° F.) are suitable.

In yet another aspect, the invention includes an improved electroplating apparatus for high speed tin-silver electroplating in which the improvement is composed of a specifically designed protective structure formed and arranged around the tin anode to shelter the tin anode from liquid agitation and to reduce the displacement of silver on the tin anode surface. The compartment may be manufactured from any non-conductive, acid resistant material, for instance polypropylene or polyethylene. The compartment is formed with an open top, walls surrounding the sides and back of the anode, and a fabric front wall positioned at or near the front of the anode and composed of woven or mapped polypropylene.

The compartment may take any basic shape, for example, rectangular, cylindrical, square, triangular. It includes interiorly a non-electrically conductive honeycomb plate, which reduces the immersion deposition of silver. The honeycomb plate is formed and positioned within the compartment adjacent to, or optionally in contact with, the front of the tin anode most proximal to the cathode for the purpose of disrupting the agitation flow of the electrolyte, toward the tin anode. The thickness of the honeycomb plate will be from 0.5 cm to 10 cm, preferably from 1 cm to 5 cm. The height and width dimensions of the honeycomb plate can be varied, so long as the plate covers enough of the anode that agitation and silver displacement are reduced to suitable levels although a plate that covers the entire front of the tin anode is preferred. The honeycomb plate is composed of a plurality of hollow cells. The diameter dimension of the individual square or hexagonal or octagonal shaped hollow cells constituting the honeycomb plate may vary from 0.1 cm to 2 cm, preferably from 0.25 cm to 1.0 cm. The honeycomb plate can be manufactured from polyethylene or polypropylene material, but any other non-conductive and acid-resistant material may be used. The plate may be attached to the compartment by any means know in the art as the manner of attachment is not critical. Optionally, the compartment may be formed with a bottom composed of solid, non-electrically conductive material.

DESCRIPTION OF THE DRAWING

The FIGURE is a schematic diagram of the anodic compartment of the invention in longitudinal cross-section.

DETAILED DESCRIPTION

The invention comprises a significant improvement over prior art compositions and methods of electroplating tin-silver alloys. The compositions of the invention, alone or in combination with the specifically designed compartment for the tin anode, eliminate the problems already reviewed by providing an aqueous, acidic electrolyte composition capable of operating at high current density and at near ambient room temperature that employs low silver concentrations. Although typical cloth anode bags reduce liquid agitation, they do not prevent the immersion deposition of silver on the anode surface. Additionally, if the anode is in contact with the cloth, the immersion deposited silver penetrated the bag. Silver immersion depositing on the anode can be significantly reduced if the anode is situated within a compartment.

The tin anode protective structure is described in detail below and exemplary tested compositions are provided thereafter.

Referring now to the FIGURE, the tin anode protective structure aspect of the invention provides a compartment, 2, for the tin anode, 3, to shelter tin anode 3 from liquid agitation and to reduce the displacement of silver on the tin anode surface. Compartment 2 may be manufactured from any non-conductive, acid resistant material, for instance polypropylene or polyethylene. Compartment 2 is formed with an open top, walls surrounding the sides and back of the anode, and a fabric front wall, 6, positioned at or near the front of the anode and composed of woven or mapped polypropylene.

The compartment may take any basic shape, for example, rectangular, cylindrical, square, triangular. It includes interiorly a non-electrically conductive honeycomb plate, 5, which reduces the immersion deposition of silver. Honeycomb plate 5 is formed and positioned within compartment 2 adjacent to, or optionally in contact with, the front of the tin anode 3 most proximal to the cathode for the purpose of disrupting the agitation flow of the electrolyte (not shown) toward the tin anode. The thickness of honeycomb plate 5 will be from 0.5 cm to 10 cm, preferably from 1 cm to 5 cm. The height and width dimensions of honeycomb plate 5 can be varied, so long as the plate covers enough of the anode that agitation and silver displacement are reduced to suitable levels although a plate that covers the entire front of the tin anode is preferred. The honeycomb plate is composed of a plurality of hollow cells. The diameter dimension of the individual square or hexagonal or octagonal shaped hollow cells constituting honeycomb plate 5 may vary from 0.1 cm to 2 cm, preferably from 0.25 cm to 1.0 cm. Honeycomb plate 5 can be manufactured from polyethylene or polypropylene material, but any other non-conductive and acid-resistant material may be used. The plate may be attached to the compartment by any means know in the art as the manner of attachment is not critical. Optionally, compartment 2 may be formed with a bottom, 8, composed of solid, non-electrically conductive material.

Exemplary electrolyte compositions of the invention are now described in the follow examples.

Example 1

A tin-silver electrolyte composition was prepared by dissolving the following ingredients in deionized water.

MSA 70% 100 ml/l
Sn, as tin methane sulfate 20 g/l
Ag, as silver methane sulfate 0.5 g/l
Thiocarbohydrazide 2 g/l
Ethoxylated Beta Napthol, with 13 EO units 5 ml/l
Pentanedial 0.25 g/l Deposition was carried out on a brass panel at 24° C. (75° F.) at a current density of 100 ASF, with simple cathode rod movement, dispersion line, or impeller agitation. A smooth and bright deposit was obtained. The determination of the alloy composition by means of x-ray fluorescence spectroscopy (XRF) yielded 97.4 wt-% Sn, 2.6 wt-% Ag.

Example 2

A tin-silver electrolyte composition was prepared by dissolving the following ingredients in deionized water.

MSA 70% 100 ml/l
Sn, as tin methane sulfate 25 g/l
Ag, as silver methane sulfate 1.5 g/l
Thiosemicarbazide 10 g/l
Ethoxylated Beta-Naphthol 2.5 ml/l
Pentanedial 0.25 g/l Deposition was carried out on a brass panel at 24° C. (75° F.) at a current density of 80 ASF, with simple cathode rod movement, dispersion line, or impeller agitation. A smooth deposit was obtained. The determination of the alloy composition by means of XRF yielded 96.3 wt-% Sn, 3.7 wt-% Ag.

Example 3

A tin-silver electrolyte composition was prepared by dissolving the following ingredients in deionized water.

MSA 70% 100 ml/l
Sn, as tin methane sulfate 25 g/l
Ag, as silver methane sulfate 1.5 g/l
Thiosemicarbazide 4 g/l
Pentanedial 0.5 g/l
Polyoxyethylenenaphtylether 0.4 g/l
Ethoxylatedpolyalkylene glycol copolymer 1.0 g/l Deposition was carried out on a brass panel at 24° C. (75° F.) at a current density of 200 ASF, with simple cathode rod movement, dispersion line, or impeller agitation. A smooth deposit was obtained. The determination of the alloy composition by means of XRF yielded 97.0 wt-% Sn, 3.0 wt-% Ag.

We claim:

1. An electrolyte composition comprising:

an aqueous, acidic solution including salts of stannous tin and silver, a sulfonic acid selected from the group consisting of alkylsulfonic acids, alkanosulfonic acids, and arylsulfonic acids singly or in combination, a complexing agent selected from the group consisting of thiosemicarbazides and thiocarbohydrazides, a dialdehyde or an aldehyde, and a non-ionic ethoxylated or propoxylated surfactant selected from the group consisting of

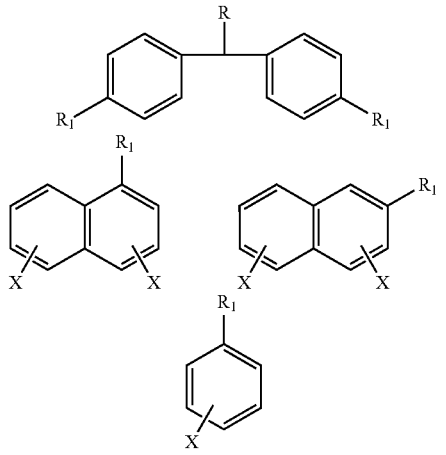

wherein R is alkyl or iso-alkyl, $R_1$ is O—($R_2$—O)$^n$—H, $R_2$ is ethyl or propyl, X is a halogen, and n is between 5 and 20.

2. The electrolyte composition according to claim 1 wherein the complexing agent selected from thiosemicarbazides and thiocarbohydrazides is represented by the formula:

$R_1HN$

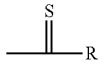

R is $NH_2$ or $NHNH_2$ $R_1$ is H, —$NH_2$ or —$NHNH_2$ or alkyl or alkylcarboxyl or amine or amidino group or $R_2$ $R_2$ is alkyl or halogen

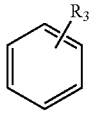

$R_3$ is alkyl or halogen.

3. The electrolyte composition according to claim 2 wherein the thiosemicarbazide is selected from thiosemicarbazide, [thiocarbohydrazide,]1-acetyl-3-thiosemicarbazide, 4-methyl-3-thiosemicarbazide, 4,4-dimethyl-3-thiosemicarbazide monohydrate, 4-(2,4-dimethylphenyl)-3-thiosemicarbazide, 3-[(4-morpholino)ethyl]-3-thiosemicarbazide, 4-[3-(4-morpholino) propyl]-3-thiosemicarbazide, 4-(2,6-dichlorophenyl)-3-thiosemicarbazide, and 4-(methyl phenyl)-3-thiosemicarbazide.

4. The electrolyte composition according to claim 3 wherein the dialdehyde is represented by the formula:

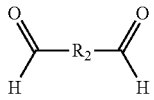

$R_2$ is alkyl or alkylaryl or aryl or heteroaryl.

5. The electrolyte composition according to claim 3 wherein the dialdehyde is selected from pentanedial, phthaldialdehyde, and isophthalaldehyde.

6. The electrolyte composition according to claim 3, wherein the aldehyde is represented by the formula:

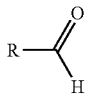

R is H, alkyl thioalkyl, alkylaryl, alkoxyaryl, cycloakyl, aryl or heteroaryl.

7. The electrolyte composition according to claim 6 wherein the aldehyde is selected from acetaldehyde, phenylacetaldehyde, 5-phenylpropionaldehyde, veratraldehyde, isonicotinaldehyde, protocatechylaldehyde, methylcinnamaldehyde, 4-diethylaminobenzaldehyde, trans-cinnamaldehyde, 4-dimethylaminobenzaldehyde, quinolinecarboxaldehyde, 5-(hydroxymethyl) furfural, 3-ethoxybenzaldehyde, 5-methylfurfural, 3-hydroxynaphthaldehyde, 4-acetamidobenzaldehyde, and 2-hydroxybenzaldehyde.

8. The electrolyte composition according to claim 2 wherein the dialdehyde is represented by the formula:

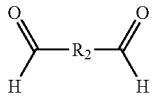

$R_2$ is alkyl or alkylaryl or aryl or heteroaryl.

9. The electrolyte composition according to claim 8 wherein the dialdehyde is selected from pentanedial, phthaldialdehyde, and isophthalaldehyde.

10. The electrolyte composition according to claim 2 wherein the aldehyde is represented by the formula:

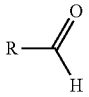

R is H, alkyl thioalkyl, alkylaryl, alkoxyaryl, cycloalkyl, aryl or heteroaryl.

11. The electrolyte composition according to claim 10 wherein the aldehyde is selected from acetaldehyde, phenylacetaldehyde, 5-phenylpropionaldehyde, veratraldehyde, isonicotinaldehyde, protocatechylaldehyde, methylcinnamaldehyde, 4-diethylaminobenzaldehyde, trans-cinnamaldehyde, 4-dimethylaminobenzaldehyde, quinolinecarboxaldehyde, 5-(hydroxymethyl) furfural, 3-ethoxybenzaldehyde, 5-methylfurfural, 3-hydroxynaphthaldehyde, 4-acetamidobenzaldehyde, and 2-hydroxybenzaldehyde.

12. The electrolyte composition according to claim 1, wherein the aldehyde is represented by the formula:

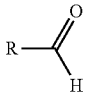

R is H, alkyl, thioalkyl, alkylaryl, alkoxyaryl, cycloakyl, aryl or heteroaryl.

13. The electrolyte composition according to claim 12 wherein the aldehyde is selected from acetaldehyde, phenylacetaldehyde, 5-phenylpropionaldehyde, veratraldehyde, isonicotinaldehyde, protocatechylaldehyde, methylcinnamaldehyde, 4-diethylaminobenzaldehyde, trans-cinnamaldehyde, 4-dimethylaminobenzaldehyde, quinolinecarboxaldehyde, 5-(hydroxymethyl) furfural, 3-ethoxybenzaldehyde, 5-methylfurfural, 3-hydroxynaphthaldehyde, 4-acetamidobenzaldehyde, and 2-hydroxybenzaldehyde.

14. The electrolyte composition according to claim 1 wherein the dialdehyde is represented by the formula:

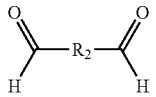

$R_2$ is alkyl or alkylaryl or aryl or heteroaryl.

15. The electrolyte composition according to claim 14 wherein the dialdehyde is selected from pentanedial, phthaldialdehyde, and isophthalaldehyde.

16. The electrolyte composition according to claim 1 wherein the alkanosulfonic acid is methane sulfonic acid.

17. A method of electroplating a tin-silver alloy onto a substrate comprising conducting an electric current through the electrolyte composition according to claim 1 between a metallic tin anode or an insoluble anode and a cathode composed of the substrate.

18. The method according to claim 17 wherein electric current in the range of 80-200 ASF (ampere per square foot) is conducted through the electrolyte composition.

19. The method according to claim 18 wherein the electrolyte composition is maintained at a temperature in the range of 50° F. to 90° F.

* * * * *